US009151469B2

(12) United States Patent
Jouffrieau et al.

(10) Patent No.: US 9,151,469 B2
(45) Date of Patent: Oct. 6, 2015

(54) LIGHTING DEVICE HAVING A SMOOTH CUT-OFF

(75) Inventors: Matthias Jouffrieau, Lyons (FR); Denis Fournier, Lyons (FR)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 121 days.

(21) Appl. No.: 13/639,877

(22) PCT Filed: Apr. 1, 2011

(86) PCT No.: PCT/IB2011/051399

§ 371 (c)(1),
(2), (4) Date: Oct. 8, 2012

(87) PCT Pub. No.: WO2011/125009

PCT Pub. Date: Oct. 13, 2011

(65) Prior Publication Data

US 2013/0044479 A1 Feb. 21, 2013

(30) Foreign Application Priority Data

Apr. 9, 2010 (EP) ..... 10305371

(51) Int. Cl.

| | |
|---|---|
| ***F21V 1/12*** | (2006.01) |
| ***F21V 13/04*** | (2006.01) |
| ***F21V 3/04*** | (2006.01) |
| ***F21V 13/10*** | (2006.01) |
| *F21V 11/00* | (2015.01) |
| *F21Y 101/02* | (2006.01) |
| *F21Y 105/00* | (2006.01) |

(Continued)

(52) U.S. Cl.

CPC . *F21V 13/04* (2013.01); *F21V 3/04* (2013.01); *F21V 13/10* (2013.01); *F21V 7/048* (2013.01); *F21V 7/06* (2013.01); *F21V 11/00* (2013.01); *F21Y 2101/02* (2013.01); *F21Y 2105/001* (2013.01)

(58) Field of Classification Search

USPC ..... 362/249.01, 249.02, 249.11, 296.01, 362/297, 299, 302, 304, 307–310, 311.02, 362/326–328, 336–341, 347, 348, 350

See application file for complete search history.

(56) References Cited

U.S. PATENT DOCUMENTS 4,035,631 A 7/1977 Day, Jr.
4,420,800 A * 12/1983 Van Horn ..... 362/297

(Continued)

FOREIGN PATENT DOCUMENTS

GB 2089956 A 6/1982
JP 3020811 B2 3/1991

(Continued)

*Primary Examiner* — Hargobind S Sawhney

(57) ABSTRACT

The invention relates to a lighting device comprising: —at least one light source (11); —a reflective member (20) comprising a reflective surface (22) and an edge (21) ("first edge") forming a light cut-off of light rays passing in a region adjacent to this first edge (21); —a light-modifying member (30) adapted to modify lighting feature(s) of light rays and having an edge ("second edge"). The light-modifying member (30) extends from the reflective member (20) to this second edge (31) over a surface area defined to receive a part of the light rays passing in said region. The second edge is designed such that, among said part of light rays, the light-modifying member (30) modifies proportionally more light rays passing proximate the first edge than light rays passing less proximate the first edge (21). The invention relates also to said light-modifying member (30) per se.

17 Claims, 7 Drawing Sheets

(51) Int. Cl.
*F21V 7/04* (2006.01)
*F21V 7/06* (2006.01)

(56) References Cited

U.S. PATENT DOCUMENTS

| | | | | | |
|---|---|---|---|---|---|
| 4,473,872 | A | * | 9/1984 | Puckett et al. | 362/309 |
| 4,506,316 | A | | 3/1985 | Thiry et al. | |
| 4,914,537 | A | | 4/1990 | Ota | |
| 5,199,787 | A | | 4/1993 | King et al. | |
| 5,698,936 | A | * | 12/1997 | Marien et al. | 313/318.11 |
| 5,934,795 | A | * | 8/1999 | Rykowski et al. | 362/309 |
| 6,406,171 | B1 | | 6/2002 | Satsukawa et al. | |
| 6,454,333 | B2 | | 9/2002 | Portal | |
| 7,040,789 | B2 | | 5/2006 | De Lamberterie | |
| 7,483,220 | B2 | * | 1/2009 | Kittelmann et al. | 359/742 |
| 8,403,526 | B2 | * | 3/2013 | Bayat et al. | 362/235 |
| 2014/0073746 | A1 | | 3/2014 | SEKISUI CHEMICAL CO., LTD. | |

FOREIGN PATENT DOCUMENTS

| | | | |
|---|---|---|---|
| JP | 05314803 | A | 11/1993 |
| JP | 2009152155 | A | 8/2009 |
| WO | 2005015078 | A1 | 2/2005 |

* cited by examiner

LIGHTING DEVICE HAVING A SMOOTH CUT-OFF

TECHNICAL FIELD

The invention relates to a luminaire or a lighting device comprising:

at least one light source, such as one or several LEDs;

a reflector (or reflective member) comprising a reflective surface and a first edge, the first edge forming a light cut-off of light rays passing proximate this first edge—the first edge defines typically the light outlet of the reflector.

The light source(s) is usually located within the reflector, the reflector being arranged to reflect the light emitted by the light source(s) in order to direct the emitted rays into specific directions to illuminate a region area limited by said light cut-off.

BACKGROUND OF THE INVENTION

Problems encountered with such reflectors are the contrast of the light that is sometimes too high at the limit or edge of the region to illuminate and/or the light is not uniform near the cut-off direction, especially when a plurality of punctual light sources is used. As a consequence the lighting effects may be unpleasant and/or non aesthetic, especially problematic for Accent Lighting or Spot Lighting applications.

It is known to use some lenses as accessories, to smooth the light beam near the cut-off direction, those lenses being typically provided at the outlet of the reflector.

For example U.S. Pat. No. 4,506,316, U.S. Pat. No. 5,199,787 and U.S. Pat. No. 7,040,789 disclosed disk-shaped lenses provided with an annular portion having a plurality of tapered optical elements to deviate the rays passing proximate the light cut-off directions.

However, the limits of the region to be illuminated may be not sufficiently controlled when using this technique and the lighting efficiency may be not optimized.

SUMMARY OF THE INVENTION

A purpose of the invention is to smooth the light cut-off region in the area to illuminate, created by said edge of the reflector, while optimizing the control over the size and shape of the area to be illuminated and limiting the light losses.

A "Light cut-off region" means the region(s) located:

in the area to illuminate; and/or in a volume crossed by non-reflected light rays, where the light is so disturbed by a light cut-off edge of the reflective member that lighting inhomogeneities can be visible for an observer.

Another purpose of the invention is to remove or decrease these unpleasant light inhomogeneities, in the light cut-off region of the area to illuminate, which appear especially when a plurality of individual lights sources (e.g. a array of LEDs) is used. Indeed, due to these discontinuities in the light source, the light cut-off region exhibits some non-continuous light sub-regions (i.e. some light steps), each having a specific light-cut-off with the adjacent sub-regions.

Another purpose of the invention is to decrease the light contrast in the light cut-off region.

To overcome these problems, the invention proposes, according to a first aspect, a lighting device comprising:

at least one light source;

a reflective member comprising a reflective surface and an edge ("first edge"), the first edge forming a light cut-off of light rays passing in a region adjacent to this first edge;

a light-modifying member adapted to modify lighting feature(s) of light rays.

According to a first embodiment of the invention, the light-modifying member has an edge ("second edge"), and the light-modifying member extends from the reflective member to this second edge over a surface area defined to receive a part of the light rays: (i) passing in said region; and (ii) non reflected by the reflective member. The second edge is designed such that, among said part of light rays, the light-modifying member modifies proportionally more light rays passing proximate the first edge than light rays passing less proximate the first edge.

In other words, said second edge is designed such that closer said light rays pass to the first edge greater the quantity of modified light rays. Accordingly, the intensity of light changes more progressively in the light cut-off region when using the light-modifying member. As a consequence, this light-modifying member smoothes said light cut-off.

Advantageously, said region adjacent to the first edge is a light cut-off region.

Moreover the light-modifying member acts only on the rays in this light cut-off region, and leaves the other rays outputting the lighting device without any disturbance. Therefore this light-modifying member does not modify most of the light emitted by the lighting device, and the overall efficiency of the lighting device is optimized accordingly.

Moreover, the invention allows an easy control of the light modification, by simply adapting the design or shape of the second edge of the light-modifying member, without modifying the reflective member.

Optionally the light-modifying member extends along, covers or is adjacent to at least a part of the first edge. This is equivalent to a replacement of this at least part of the first edge by the second edge, without modifying the integrity of the reflective member, but only by adding this light-modifying member to the lighting device. Therefore the light cut-off can be easily smoothened without modifying or changing the reflector and without necessarily removing the reflective member from the holding structure to which it may be attached. This is especially advantageous if the reflector is already in a place and not easily accessible and/or is not easily dismountable.

Alternatively the light-modifying member may extend along a line on the reflective surface defined as being equidistant to the first edge. This particular embodiment can allow providing the light-emitting member inside the reflective member, and being therefore less visible than in the previous embodiment. The light-modifying member can be attached directly within the reflective member or between two sub-portions of the reflective member.

According to a second embodiment of the invention, taken sole or in combination with said first embodiment, the light modifying member comprises a plurality of light modifying elements delimited by the said second edge and spaced apart one to the other by respective light transparent regions, wherein each light transparent region has a first end and a second end opposite to the first end, wherein the first end is:

closer to the reflective surface than the second end, and smaller than the second end.

The shape of at least one of said light transparent regions is an entire triangle or a triangle with a rounded vortex which is the first end. Alternatively or in combination, at least one said transparent regions is progressively wider from its first end to its second end.

Optionally, the light modifying member may comprise a base fixed or attached or assembled to the reflective member, the light modifying elements extending from the base outwardly from the reflective member.

According to a third embodiment of the invention, taken sole or in combination with said first and/or second embodiments, at least one light modifying element has a first end and a second end opposite to the first end, wherein the first end is:

closer to the reflective surface than the second end, and greater than the second end.

The overall shape of at least one of said light modifying elements is entirely triangular or triangular with the second end which is rounded. Alternatively or in combination, the light modifying elements extend outwardly from the reflective member according to angles in the range between 0° and 90° with respect to a main light direction, the main light direction being the direction along which the intensity of the light emitted by the light source(s) is maximized with respect to the other directions.

Optionally, the lighting device comprises an array or a array of light sources, wherein light sources are chips of LED having a width "e" and spaced apart one to the other over a distance "h", at least a part of said light modifying elements extending outwardly from the reflective member over a length of about "h" and have widths of about "e".

Optionally, the surface area of each light-modifying element is similar to the surface area of each gap. As a consequence, the lighting is more homogeneous around the center of the illuminated surface area.

Optionally, the lighting device is arranged such that the quantity of non-reflected rays emitted by one of said light source(s) over a first direction is significantly lower than the quantity of non-reflected light emitted by the same light source(s) over a second direction, wherein a light cut-out exists between these two directions, and wherein the second edge of the light-modifying member is designed to smooth progressively this light cut-off.

Optionally, the lighting device comprises a plurality of light sources and is arranged such that:

the quantity of non-reflected light emitted by at least one light source over a first direction is different from the quantity of non-reflected light emitted by this at least one light source over a second direction, by a first differential quantitative value; and that the quantity of non-reflected light emitted by at least one other light source over the first direction is different from the quantity of non-reflected light emitted by this at least one other light source over the second direction, by a second differential quantitative value;

wherein the first differential quantitative value is significantly greater than the second differential quantitative value and a light cut-out exists between these two directions; and wherein the second edge of the light modifying member is designed to smooth progressively this light cut-off.

Optionally the light modifying member absorbs and/or diffuses said part of light to prevent it to pass proximate the first edge.

According to a second aspect, the invention proposes a light modifying member arranged to be fixed, attached or assembled to a reflective member of an lighting device, wherein the lighting device comprising:

at least one light source;

said reflective member comprising a reflective surface and an edge ("first edge") forming a light cut-off of light rays passing in a region adjacent to this first edge;

wherein the light-modifying member is adapted to modify lighting feature(s) of light rays, having an edge ("second edge") such that the it extends from the reflective member to this second edge over a surface area defined to receive a part of the light rays passing in a region adjacent to the first edge and non reflected by the reflective surface, wherein the second edge is designed such that, among said part of light rays, the light-modifying member modifies proportionally more light rays passing proximate the first edge than light rays passing less proximate the first edge.

DETAILED DESCRIPTION OF THE INVENTION

Figure 1:
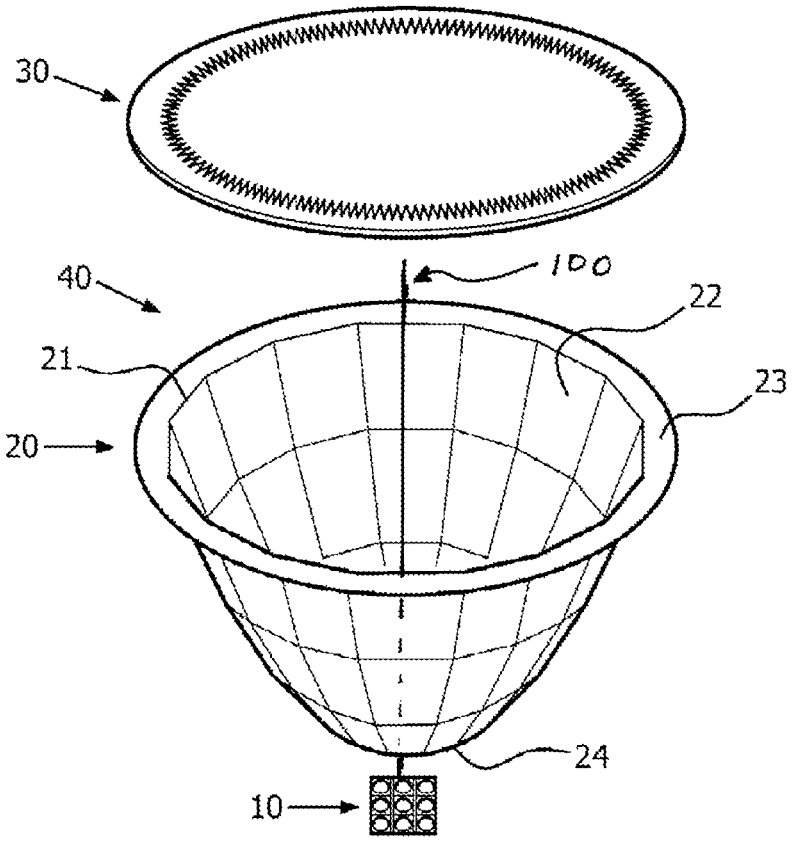
FIG. 1 is an exploded view of a lighting device according to the invention.

FIG. 1 shows a light device 40 according to the invention comprising:

a light source assembly 10;

a reflector 20 comprising a reflective surface 22 and a first edge 21;

a light-modifying member 30 adapted to modify lighting feature(s) of light rays.

The light source assembly 10 may comprise one or a plurality of light source(s). The plurality of light sources may extend over a line, a plane or a volume. A light source may be any kind of light source, such as an incandescent lamp, halogen lamp, a high-intensity discharge (so-called HID) lamp or a light-emitting diode (LED). The light source assembly 10 may comprise a unique or a plurality of support(s) of the light source(s) provided with electrical and/or electronic path to a current supply and optionally to a light controller. The circuit board may comprise this lighting controller. A heat sink or nay other cooling system may be provided beneath the LEDs or the circuit board, to dissipate the heat from the LEDs. The light source assembly 10 may further comprise primary optics, such as lenses, designed to redirect the light emitted by the light source(s). The light source assembly 10 may further comprise some additional components, such as for example a diffusing element (e.g. a diffusing coating or film, or a diffusing panel) provided on the light source(s) or between the light source and the primary optics or on the primary optics.

In the example depicted by FIG. 1, the light source assembly 10 comprises a array of LEDs, fixed to a circuit board and/or to a heat sink, and covered by a primary optical element (comprising a plurality of elementary lenses). This light source assembly 10 may be arranged as a closed pack solution, i.e. a solution which provides a compact light source assembly 10. Such a closed pack solution may be made by using the technique reflow soldering to mount the LEDs onto the circuit board or onto the heat sink. The array may be square, rectangular, round, ellipsoidal or of any other configuration. Each LED might be seen as a light point or as a small light spot. This closed pack solution allows having a high density of light emission over a limited surface, leading to a more compact lighting device 40.

The reflector 20 may be closed or opened.

In the example of FIG. 1, the reflector 20 is closed and have a main optical axis 100.

The main optical axis 100 can be defined as an axis of symmetry of the reflector 20 or as an axis of symmetry of the light or as an axis along which the intensity of the emitted light is maximum. The main optical direction 100 is the same as the main optical axis 100, but directed outwardly from the light sources.

This reflector 20 might be of any shape. For example, the reflector 20 may be generally hemispherical, parabolic, tapered. The reflector 20 may have a square, rectangular, round, ellipsoidal, triangular, or any other cross-section shape (taken perpendicular to the main optical axis 100). The reflective face 22 of the reflector 20 may be continuous or made of a plurality of flat faces (as depicted in FIG. 1).

In the example depicted by FIG. 1, the light outlet of the reflector 20 is limited by the first edge 21. This light outlet may have any shape, e.g. a square, rectangular, round, ellipsoidal or triangular shape. Optionally, a flange 23 may extend from the first edge 21 transversal to and outwards from the main optical axis 100.

The bottom portion 24 of the reflector 20 may be provided with an aperture to receive the light source assembly 10 within. Alternatively, the light source assembly 10 may be provided in the reflector 20 and through holes are provided in the bottom portion 24 of the reflector 20 to allow the electrical connection to the light source assembly 10.

The light-modifying member 30 may extend along at least a part of the first edge 21 (as depicted in FIG. 1) and therefore around at least a part of said light outlet. Optionally, another reflective member (not shown) may be added onto the reflector 20, the light-modifying member 30 being located at the interface.

Alternatively, the light-modifying member 30 may extend along a line on the reflective surface 22 defined to be equidistant to the first edge 21 (not shown).

The light-modifying member 30 may be an accessory added to the lighting device 40 or may be integral with the reflector 20.

The light-modifying member 30 may be fixed or attached to the reflector 20 by gluing, by mechanical fixation means (e.g. screws, bolt/nuts), by soldering, or any other relevant kind of means for attaching of fixing the light-modifying member 30.

The light-modifying member 30 is adapted to modify lighting characteristic(s) of a part of the light rays passing proximate the first edge 21 of the reflector, in a light cut-off region.

To this effect, the light-modifying member 30 may have light absorbing, diffusing and/or reflective properties. The material chosen for such member 30 may be a translucent polymer, clear polymer with at least one textured surface, clear glass with a textured area, or a combination thereof.

The light-modifying member 30 has an edge 31 ("second edge") designed such that said part of light rays modified by the light-modifying member 30 is greater for some light rays passing more proximate the first edge 21 than some other light rays passing less proximate the first edge 21. Preferably, the light-modifying member 30 comprises a plurality of light-emitting elements 32 which extends in the light cut-off region of the first edge 21 so as to smooth the downstreamed light in this region.

Figure 2A:
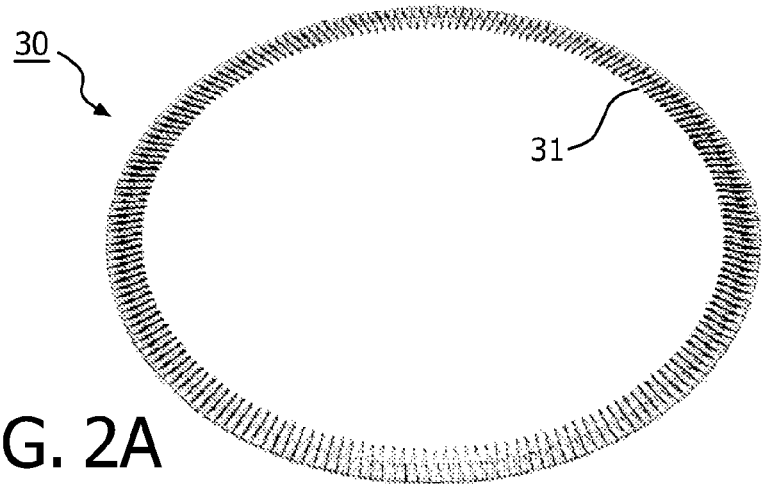
FIG. 2A is a perspective view of a light-modifying member according to the invention.

FIG. 2A shows an example of such a light-modifying member 30 according to the invention, which is arranged to be placed along or in vicinity to a rounded first edge 21 of the reflector 20. This particular light-modifying member 30 comprises a base 33 to be attached to the flange 23 of the reflector 20. For example, a method of attaching the light-modifying member 30 to the flange 33 is to provide some protrusions, rods or rivets equally distributed over the surface of the flange 23 and corresponding through holes in the base 33 to receive this protrusions. Once this montage is performed, a way to seal or fix the light-modifying member 30 onto the flange 23 can be done, by for instance soldering the protrusions to the base 33 or providing a kind of blot on the end portions of the protrusions.

Preferably, the light-modifying member 30 further comprise light-modifying elements 32 extending from the base 33 transversal to and towards the main optical axis 100 over a region relating to the light cut-off region of the first edge 21. The edge of the light-modifying elements 32 is said second edge 31.

The light-modifying elements 32 are preferably separated by some gaps 39 or light transparent regions (which is for example a transparent solid material such as glass) having respectively a first end 39' and a second end 39", wherein the first end 39' is:

closer to the reflective surface 22 (or to the base 33) than the second end 39", and smaller than the second end 39".

As a consequence, less non-reflected light rays pass through the first end 39' than light rays passing through the second end 39". The light in the light cut-off region is therefore smoothened downstream the light-modifying element 30.

Preferably, each gap 39 is progressively wider from the first end 39' to the second end 39". The smoothing of the light in the light cut-off region is improved accordingly.

Figure 2B:
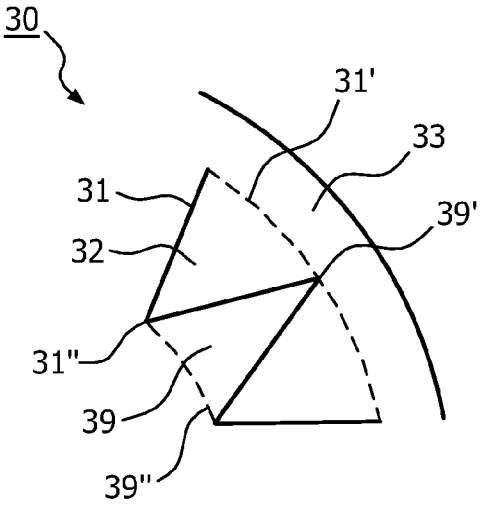
FIGS. 2B, 2C, 2D and 2E are top views of a part of light-modifying members according to various embodiments of the invention.
Figure 2C:
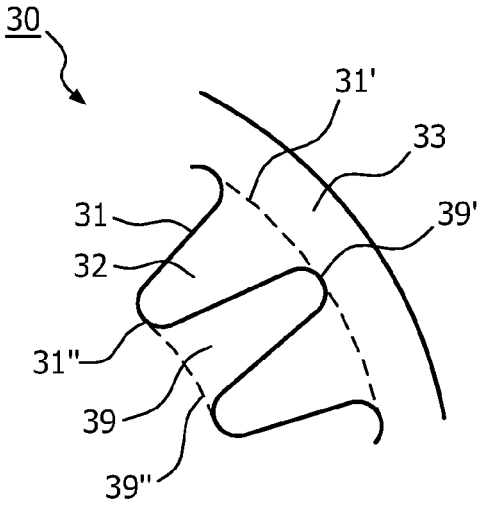
Figure 2D:
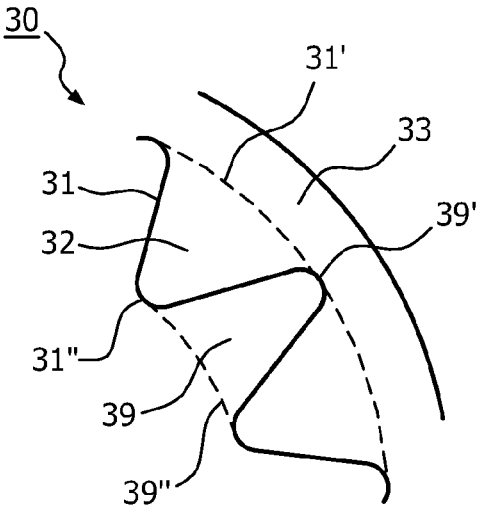
Figure 2E:
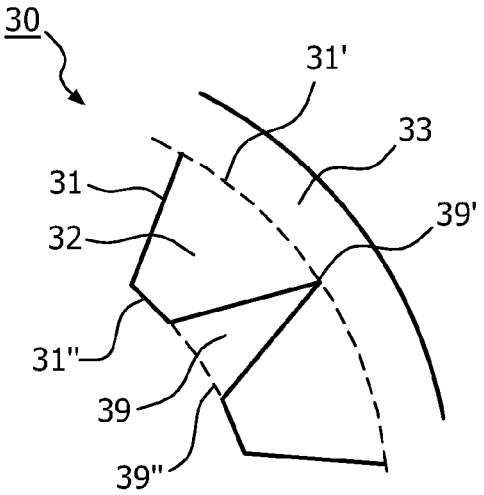

As an example, depicting by FIG. 2B or FIG. 2E, at least one light gap 39 is shaped as an entire triangle.

As another example, depicting by FIG. 2C, at least one light gap 39 is shaped as a triangle with a rounded vortex as the first end 39'.

As another example, depicting by FIGS. 2C and 2D, at least one light gap 39 is shaped as a triangle with a rounded vortex as the first end 39'.

As another example, depicted by FIG. 2C, at least one light-modifying element 32 has a rounded end portion 31" limited by a portion of a circle.

Other kinds of shapes of gaps 39 can be designed by the designers of the light-modifying member 30 so as to reach a desired lighting effect.

Alternatively or in combination of the embodiment with gaps 39, at least one light modifying element 31 may have a first end 31' and a second end 31" opposite to the first end 31', wherein the first end 31' is:

closer to the reflective surface 22 (or to the base 33) than the second end 32", and wider than the second end 32".

As a consequence, there are more light rays modified by the first end 32' than light rays modified by the second end 32". The light in the downstream light cut-off region is therefore smoothened.

Preferably, each light-modifying element 32 is progressively less wide from the first end 32' to the second end 32". The smoothing of the light in the light cut-off region is improved accordingly.

As an example, depicted by FIG. 2B, at least one light-modifying element 32 is shaped as an entire triangle.

As another example, depicted by FIG. 2C, at least one light-modifying element 32 is shaped as a triangle with a rounded vortex as the second end 31".

As another example, depicted by FIG. 2D, at least one light-modifying element 32 is rounded-shaped, whose the end portion 31" is limited by a portion of a circle.

As another example, depicted by FIG. 2E, at least one light-modifying element 32 is shaped as a triangle whose apex has been cut off at the second end 31".

Other kinds of shapes of light-modifying elements 32 can be designed by the designers of the light-modifying member 30 so as to reach a desired lighting effect.

Figure 3:
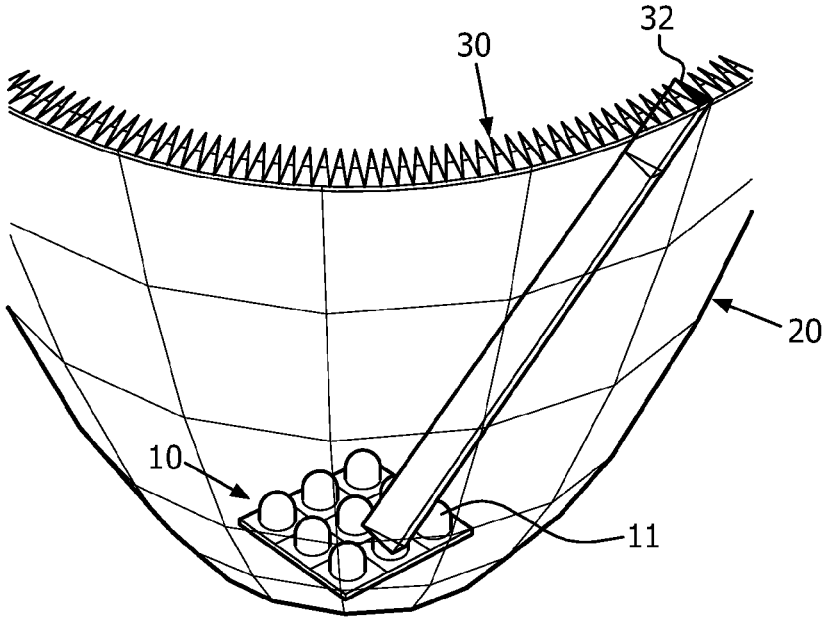
FIGS. 3, 4, 5 and 6 are perspective views of a part of a lighting device comprising a light-modifying member according to, respectively, a first, second, third and fourth embodiments of the invention, and showing at least a part of the emitted non-reflected light rays incident onto an element of these light-modifying members.
Figure 4:
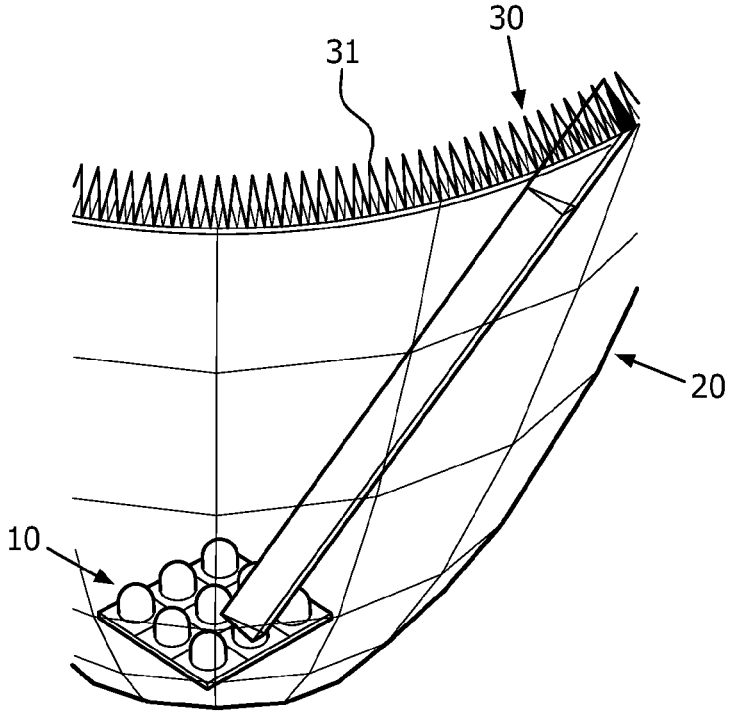
Figure 5:
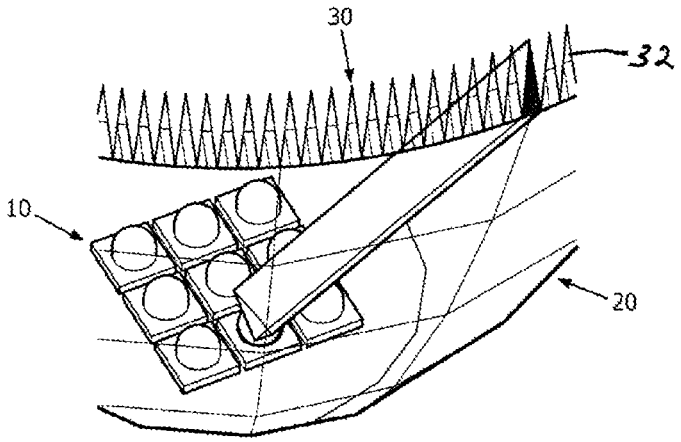

Preferably, the light-modifying elements 32 extend outwardly from the reflective member 22 according to angles in the range between 0° and 90° with respect to the main optical direction 100 (wherein the origin of this angular referential being defined by the intersection between the main optical axis 100 and the surface on which the LEDs are fixed to). FIGS. 3, 4 and 5 show an lighting device 40 where the light-modifying elements 32 are respectively at 0°, 45° and 90° with respect to the main optical direction 100.

Figure 6:
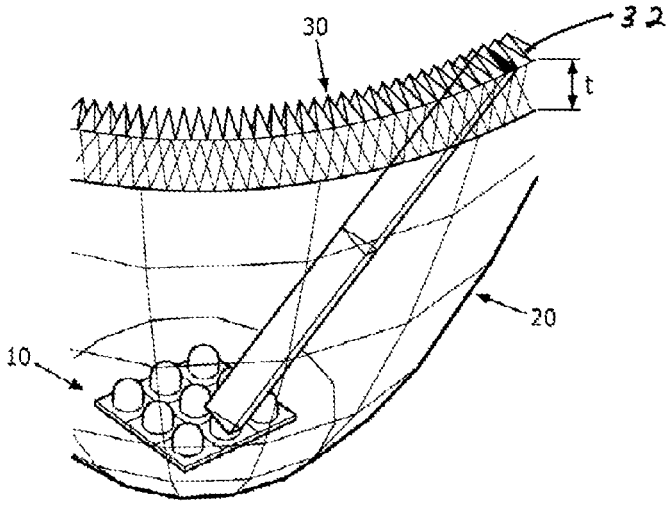

In a particular embodiment shown in FIG. 6, the light-modifying member 30 has a thickness "t", this thickness being taken parallel to the main optical axis 100. Preferably <<t>> is chosen significantly smaller than "h" to avoid intercepting too many rays and thus reducing the impact on the system efficiency.

Figure 7A:
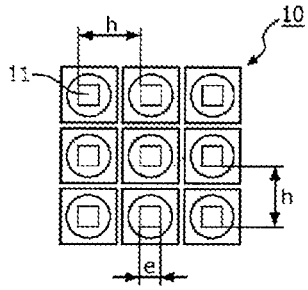
FIG. 7A is a top view of a array of nine LEDs.
Figure 7B:
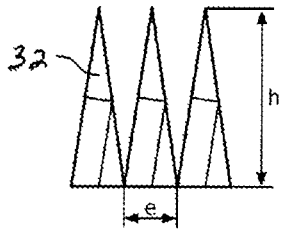
FIG. 7B is a side view of a part of a light-modifying member according to the invention.

In another particular embodiment, shown in FIGS. 7A and 7B, the light source assembly 10 is a array of a plurality of LEDs 11, each equally spaced apart by a distance "h", each LEDs having a size of "e". The light-modifying member 30 is arranged such that at least a part of the light-modifying elements 32 are spaced apart by a distance equal, similar to or close to "e" and have a length equal, similar to or close to "h".

Figure 9A:
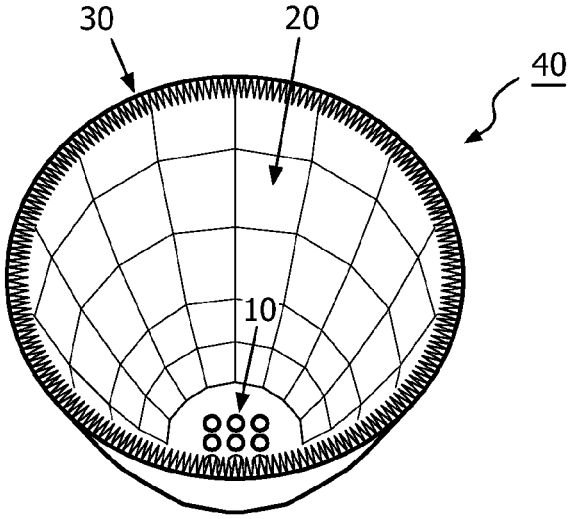
FIG. 9A, 9B, 9C are first, second and third perspective views of an lighting device according to the invention.
Figure 9B:
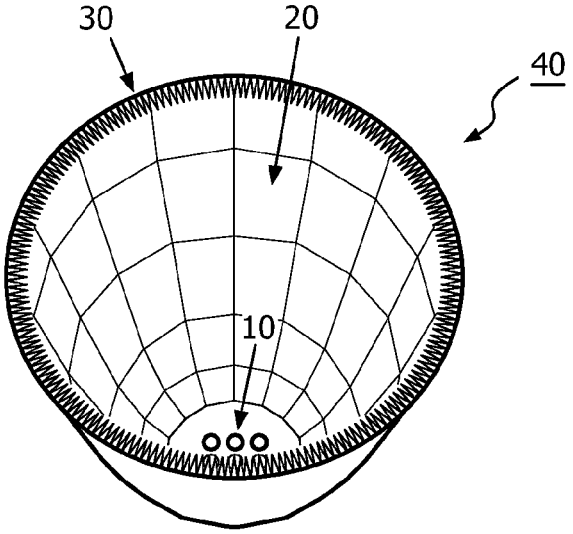

A consequence of the presence of this kind of light-modifying member 30 in the lighting device 40 is not only the smoothness of the light cut-off but also the disappearance of the light steps in the light-cut region, explained as follows in view of the FIG. 9A to 9C (which show a top perspective view of the same lighting device 40 but at, respectively, three different view angles or directions with respect to the main optical direction 100):

Without the light-modifying member 30, the first edge 21 (not shown in FIG. 9A to 9C) of the reflector 20 hides suddenly (i) the first line of LEDs 11 of the array of LEDs at a direction located between the direction of FIG. 9A and the direction of FIG. 9B; (ii) the second line of LEDs 11 of the array of LEDs at a direction located between the direction of FIG. 9B and the direction of FIG. 9C; and (iii) the third line of LEDs 11 of the array of LEDs at a direction located beyond the direction of FIG. 9C. These three events lead, respectively, to the three light cut-off 4, 5 and 6 (see curve 1 of FIG. 10B) in the light cut-off region 3, and to unpleasant light steps in the light cut-off region.

Figure 8:
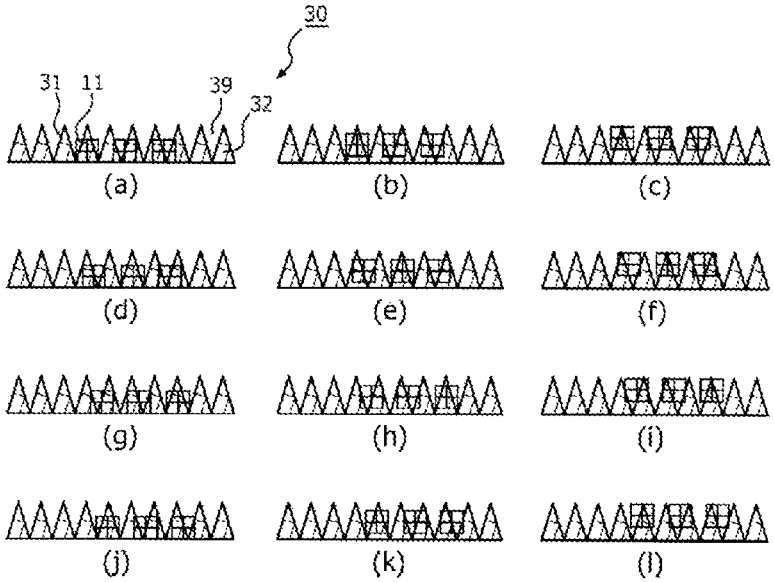
FIG. 8 is a schematic illustration of how the light-modifying member can mask an array of three LEDs.
Figure 9C:
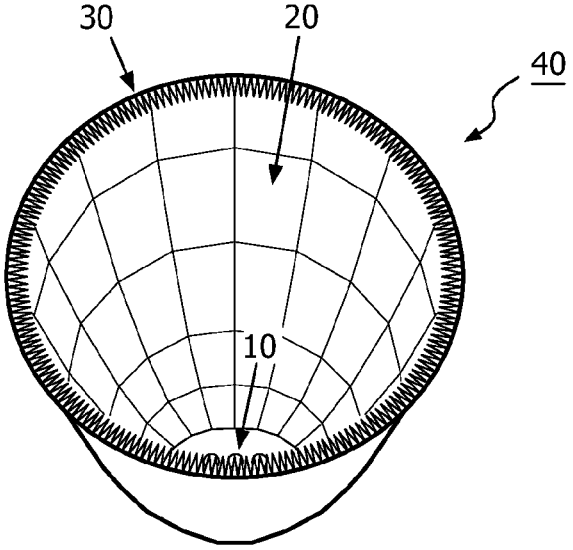

Now, the provision of said light-modifying member 30 in the lighting device 10, as depicted in FIG. 9A through 9C, allows a transition between successive lines or LEDs when the view angle (or direction) changes, by preventing progressively less and less non-reflected light emitted from a line of LEDs 11 to pass close to the first edge 21 when the view angle (or the direction) with respect to the main optical direction 100 becomes less and less important. This progression is depicted by FIG. 8, wherein:

FIG. 8(*a*), 8(*b*), 8(*c*) represent the vision of the lighting device 40 at, respectively, three different directions (or view angles), progressively closer and closer to the main optical direction 100, at a first latitude around the main optical axis 100;

FIG. 8(*d*), 8(*e*), 8(*f*) represent the vision of the lighting device 40 at, respectively, three different directions (or view angles), progressively closer and closer to the main optical direction 100, at a second latitude around the main optical axis 100;

FIG. 8(*g*), 8(*h*), 8(*i*) represent the vision of the lighting device 40 at, respectively, three different directions (or view angles), progressively closer and closer to the main optical direction 100, at a third latitude around the main optical axis 100;

FIG. 8(*j*), 8(*k*), 8(*l*) represent the vision of the lighting device 40 at, respectively, three different directions (or view angles), progressively closer and closer to the main optical direction 100, at a fourth latitude around the main optical direction 100.

Now, if the four visions of the light device 40, at each latitude, are compared one to the other, it can be noticed that the visible area of LEDs (i.e. not hidden by the light-modifying elements 32) becomes progressively higher when the directions become closer to the main optical direction 100. This means that, in the light cut-off region, there are progressively more non-reflected light rays going out the reflector 20.

Figure 10A:
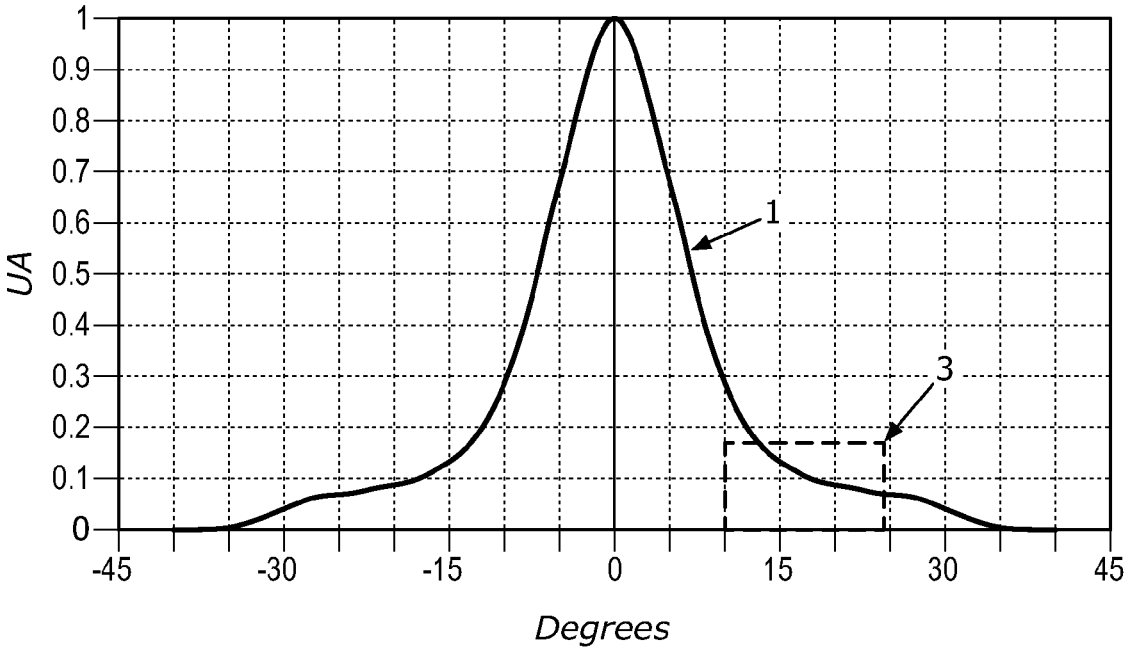
FIG. 10A is a graph of normalized intensities (y-axis) of light output measured from the lighting device according to FIG. 1 but without the light-modifying member, according to different angles (x-axis), the zero-reference of these angles corresponding to the main optical axis of the lighting device.
Figure 10B:
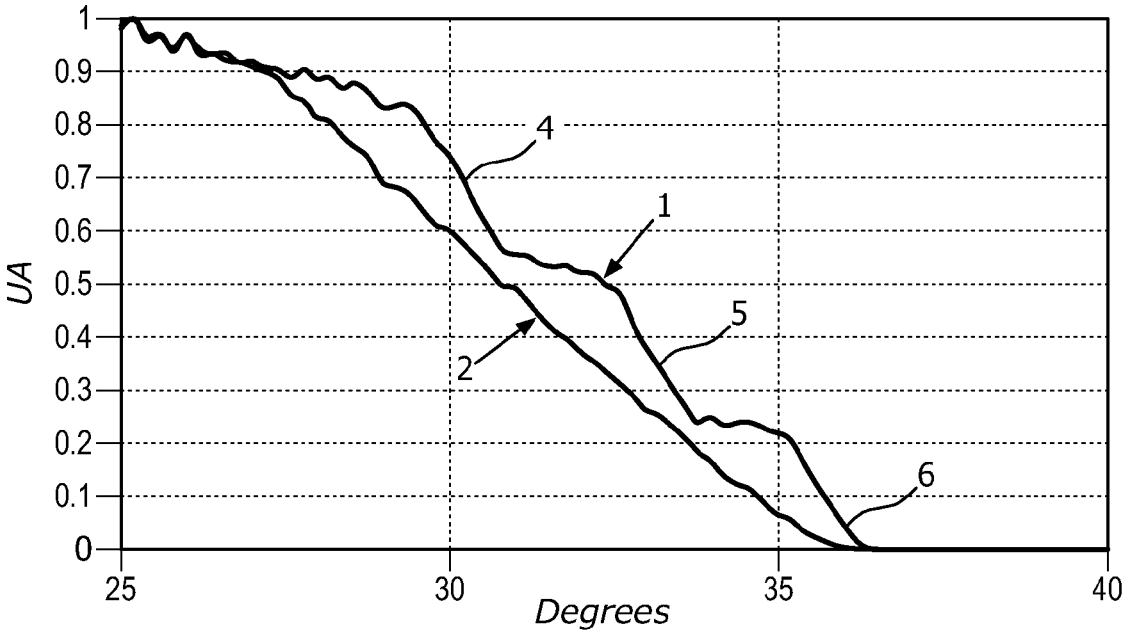
FIG. 10B is the part 3 of the graph of FIG. 10A, in comparison with the part of another graph relating to the same lighting device but with the light-modifying member.

This leads to such a smoothness of the light cut-offs 4, 5 and 6 that these light cut-offs disappear (see the resulting curve 2 of FIG. 10B—obtained with the light-modifying member 30—in comparison with curve 1 of FIG. 10B—obtained without the light-modifying member 30).

In a more particular embodiment of the invention, the area of at least a part of the light-emitting elements 32 are defined as being equal or similar to the area the adjacent gaps 39.

The lighting consequence is depicted by FIG. 8, wherein:

FIGS. 8(*a*), 8(*d*), 8(*g*) and 8(*j*) represent the vision of the lighting device 40 at a first direction (or first view angle) with respect to the main optical direction 100, at respectively four different latitudes around the main optical axis 100;

FIGS. 8(*b*), 8(*e*), 8(*h*) and 8(*k*) represent the vision of the lighting device 40 at a second direction (or second view angle) with respect to the main optical direction 100, at respectively four different latitudes around the main optical axis 100; and FIGS. 8(*c*), 8(*f*), 8(*i*) and 8(*l*) represent the vision of the lighting device 40 at a third direction (or third view angle) with respect to the main optical direction 100, at respectively four different positions latitudes around the main optical axis 100.

Now, if the three visions of the lighting device 40 are compared one to the other for each direction, it can be noticed that the visible area of LEDs (i.e. not hidden by the light-modifying elements 32) are similar from one latitude to another latitude around main optical axis 100. This means that the light remains homogeneous around the lighting device 40 at a fixed direction, whatever the position around the lighting device 40 is. The result is a well-balanced lighting on the area to illuminate.

Alternatively, the area and gaps between the light-modifying elements may be chosen differently in order to reach a determined lighting effect.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the first edge 21 is not round and the LED array is square, but the first edge is a square and the LEDs are arranged in round or any other configuration. Moreover, the light-modifying elements are not necessarily triangular but can have other kinds of shapes.

Also, the invention is not necessarily limited to a lighting device 40 with a plurality of light sources, but also relates to lighting device 40 having only one light source (e.g. one LED). In particular, the quantity of non-reflected rays emitted by this light source over a first direction may be significantly lower than the quantity of non-reflected light emitted by the same light source over a second direction, and wherein a light cut-out exists between these two directions: thus, the second edge 31 of the light modifying member 30 may be designed to smooth progressively this light cut-off.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lighting device comprising:

at least one light source;

a reflective member for receiving light emitted by the at least one light source, said reflective member comprising a reflective surface and a first edge forming a light cut-off of light rays passing in a region adjacent to said first edge;

a light-modifying member configured to modify one or more lighting feature of light rays, having a second edge, the light-modifying member extending from the reflective member to said second edge over a surface area defined to receive a part of the light rays passing in said region and not reflected by the reflective surface, wherein the second edge is configured such that, among said part of light rays, the light-modifying member modifies proportionally more light rays passing proximate to said first edge than light rays passing less proximate said first edge;

wherein the light modifying member comprises a plurality of light modifying elements delimited by said second edge and spaced apart one to the other by respective light transparent regions, wherein each light transparent region has a first end and a second end opposite to the first end, wherein the first end is:

closer to the reflective surface than the second end, and smaller than the second end.

2. The lighting device according to claim 1, wherein the light modifying member extends along at least a part of the first edge.

3. The lighting device according to claim 1, wherein the shape of at least one light transparent region is an entire triangle.

4. The lighting device according to claim 1, wherein at least a part of one light transparent region is progressively wider from its first end to its second end.

5. The lighting device according to claim 1, wherein the light modifying comprises a base fixed or attached or assembled to the reflective member, the light modifying elements extending from the base outwardly from the reflective member.

6. The lighting device according to claim 1, wherein at least one light modifying element has a first end and a second end opposite to the first end, wherein the first end is:

closer to the reflective surface than the second end, and greater than the second end.

7. The lighting device according to claim 6, wherein the shape of at least one light modifying element is an entire triangle.

8. The lighting device according to claim 1, wherein the light modifying elements extend outwardly from the reflective member according to angles in the range between 0° and 90° with respect to a main light direction, the main light direction being the direction of emitted light rays along which the intensity of the light is maximum.

9. The lighting device according to claim 1, comprising an array of light sources, wherein these light sources are LED chips having a width "e" and spaced apart one to the other over a distance "h", and wherein at least a part of the light modifying elements extend outwardly from the reflective member over a length of about "h" and have widths of about "e".

10. The lighting device according to claim 1, wherein the surface area of each light-modifying element is similar to the surface area of each gap.

11. The lighting device according to claim 1, wherein the quantity of non-reflected rays emitted by one of said light source(s) over a first direction is significantly lower than the quantity of non-reflected light emitted by the same light source(s) over a second direction, wherein a light cut-out exists between these two directions, and wherein the second edge of the light modifying member is designed to smooth progressively this light cut-off.

12. The lighting device according to claim 1, comprising a plurality of light sources wherein:

the quantity of non-reflected light emitted by at least one light source over a first direction is different from the quantity of non-reflected light emitted by this at least one light source over a second direction, by a first differential value;

the quantity of non-reflected light emitted by at least one other light source over the first direction is different from the quantity of non-reflected light emitted by this at least one other light source over the second direction, by a second differential value;

wherein the first differential value is significantly greater than the second differential value and a light cut-out exists between these two directions; and wherein the second edge of the light modifying member is designed to smooth progressively this light cut-off.

13. The lighting device according to claim 1, wherein the light modifying member absorbs said part of light.

14. The lighting device according to claim 1, wherein the light modifying member extends along a line on the reflective surface equidistant to the first edge.

15. The lighting device according to claim 1, wherein the shape of at least one light transparent region is a triangle with a rounded vortex which is the first end.

16. The lighting device according to claim 1, wherein the shape of at least one light modifying element is a triangle with a rounded vortex which is the second end.

17. The lighting device according to claim 1, wherein the light modifying member diffuses said part of light.

* * * * *